US006059562A

United States Patent [19]

Anderson, II

[11] Patent Number: 6,059,562

[45] Date of Patent: May 9, 2000

[54] GAS APPLIANCE WITH AUTOMATIC GAS SHUT-OFF DEVICE RESPONSIVE TO FLAME OUTAGE

[75] Inventor: Elmer D. Anderson, II, Valparaiso, Ind.

[73] Assignee: Bethlehem Steel Corporation, Del.

[21] Appl. No.: 09/133,133

[22] Filed: Aug. 13, 1998

[51] Int. Cl.[7] ..... F23N 5/10

[52] U.S. Cl. ..... 431/80; 431/78; 431/69; 431/42; 431/55; 431/52; 431/353; 431/264; 431/263; 431/12

[58] Field of Search ..... 431/80, 79, 78, 431/77, 75, 61, 42, 50, 51, 52, 55, 47, 202, 353, 263, 264, 265, 266, 69, 24, 12, 6

[56] References Cited

U.S. PATENT DOCUMENTS

| | | | |
|---|---|---|---|
| 1,881,766 | 10/1932 | Lundius et al. | 431/77 |
| 2,198,895 | 4/1940 | Wetzel | 431/52 |
| 2,367,119 | 1/1945 | Hess | 158/27.4 |
| 2,443,892 | 6/1948 | Caparone | 431/81 |
| 2,618,321 | 11/1952 | Spies, Jr. | 158/27.4 |
| 3,005,487 | 10/1961 | Thiele | 431/52 |
| 3,224,487 | 12/1965 | McInerney et al. | 431/50 |
| 3,338,287 | 8/1967 | Clark | 431/69 |
| 3,905,755 | 9/1975 | Aske | 431/154 |
| 4,741,691 | 5/1988 | Messimer | 431/202 |
| 4,762,488 | 8/1988 | Schilling | 431/350 |
| 4,815,426 | 3/1989 | Henschel | 123/142.5 |
| 4,976,608 | 12/1990 | Hyde | 431/264 |
| 5,195,885 | 3/1993 | Medina | 431/78 |
| 5,370,528 | 12/1994 | Mattus | 431/258 |
| 5,516,282 | 5/1996 | Somerville | 431/352 |
| 5,636,978 | 6/1997 | Sasaki | 431/69 |
| 5,722,823 | 3/1998 | Hodgkiss | 431/80 |

*Primary Examiner*—Ira S. Lazarus
*Assistant Examiner*—Josiah C. Cocks
*Attorney, Agent, or Firm*—Harold I. Masteller, Jr

[57] ABSTRACT

A gas appliance is provided for producing an open flame. The gas appliance includes an elongated gas tube, a gas inlet, a nozzle, a flame sensor, a gas shut-off valve, and a protective member. The gas tube has a proximal end and a distal end. The gas inlet is located near the proximal end, for connection to a source of combustible gas. The nozzle is located at the distal end, for expelling the combustible gas to produce the open flame. The flame sensor detects the open flame and communicates its absence or presence to the gas shut-off valve. The gas shut-off valve has a valve inlet, a valve outlet, a control input, and the over-ride mechanism. The valve inlet is connected to the gas inlet. The valve outlet is connected to the proximal end of the elongated gas tube. The control input is responsive to absence of the open flame as detected by the flame sensor so that the gas shut-off valve automatically closes when the flame is absent to keep the combustible gas from flowing from the valve inlet through the valve outlet. The over-ride mechanism is manually actuatable to over-ride the control input by opening the valve inlet to the valve outlet even if the flame is absent. The protective member is arranged around at least one of the flame sensor and the gas shut-off valve to protect these components. A method is provided for discharging combustible gas into the open flame in a manner dependent upon the presence of the open flame.

51 Claims, 2 Drawing Sheets

GAS APPLIANCE WITH AUTOMATIC GAS SHUT-OFF DEVICE RESPONSIVE TO FLAME OUTAGE

BACKGROUND OF THE INVENTION

The present invention relates to a gas appliance for producing an open flame, and more specifically, to a gas appliance which is durable and includes an automatic gas shut-off device responsive to flame outage so that the gas appliance can operate safely even if left unattended. The present invention also relates to a method of safely producing an open flame wherein a supply of combustible gas is terminated automatically in response to extinguishment of the flame.

Gas appliances capable of producing an open flame are generally known. Such gas appliances are used in places where the accumulation of certain unburned or incompletely burned gases is to be avoided. One such place is the lower area around a typical blast furnace. The lower part of a blast furnace emits carbon monoxide (CO) gas, through openings in the blast furnace. An open flame in the CO gas advantageously keeps the carbon monoxide gas ignited and reduces the level of carbon monoxide around the furnace. It is known that a significant accumulation of CO gas, or any other combustible gas, presents a danger to anyone subsequently entering the area where the gas has accumulated. Not only is there a danger of asphyxiation, but also a danger of explosion if the concentration of the gas reaches high enough levels. Thus, in an effort to prevent such accumulations of CO gas, gas appliances that produce an open flame are placed around the typical blast furnace. The level of carbon monoxide that exists below the blast furnace is too high for humans to breathe for extended periods of time, and therefore, the gas prohibits workers from remaining in that area without the aid of supplemental breathing devices. Since the use of breathing devices requires extensive training, and it involves considerable time and expense to purchase and maintain, such breathing devices, they are not widely used within the industry. It is also very expensive to monitor an open flame gas appliance when they are used around a blast furnace. Iron-makers are reluctant to assign valuable personel to simple monitoring tasks because of high labor costs, and automatic monitoring equipment is both expensive to purchase and expensive to maintain. Such costs make monitoring activities very uneconomical.

Accordingly, such gas appliances have been left unattended at various positions along the underhearth area of a blast furnace. This presents a different danger for iron-makers. If the flame is accidently or unexpectedly extinguished by the gas supply being momentarily interrupted, or by a gust of wind that extinguishes the flame, or for any other reason, the combustible gas is free to accumulate around the blast furnace. Eventually, as has happened in the past, the combustible gas finds an alternative ignition source and explodes, causing serious injuries and damage.

Consequently, there is a need within the industry for a gas appliance capable of providing an open flame, and capable of automatically terminating the flow of gas through the appliance if the flame is extinguished so that the gas appliance can be used safely even if left unattended. Such an appliance must be relatively uncomplicated to reduce manufacturing costs and must be durable to withstand heavy industrial use. It is also necessary to provide a gas appliance that is capable of producing an open flame and that satisfies Occupational Safety and Health Administration (OSHA) requirements and guidelines promulgated by the U.S. Department of Labor. For example, according to 29 C.F.R. § 1910.110 (c)(5)(h), portable heaters shall be equipped with an approved automatic device to shut off the flow of gas to the main burner, and pilot if used, in the event of flame extinguishment.

Since the need for a gas appliance frequently arises in an industrial environment (e.g., around a blast furnace, construction site, and the like), it is important that a gas appliance be able to withstand the type of abuse found in such of environments. A gas appliance, in this regard, should be able to withstand damage when dropped, and within reason, should be able to withstand crushing when heavy objects are dropped upon it. Hence, there is a need for a gas appliance that not only automatically shuts off the flow of gas when the flame is extinguished, but one that includes a protective member to shield critical elements of the gas appliance from damage (e.g., a gas shut-off valve, a flame or heat sensor associated therewith, and any communication lines extending between the valve and the sensor). Without a protective member or shield, the critical elements of a gas appliance are vulnerable to damage. Damage to such critical elements, in turn, can create significant problems, such as gas leaks, an inability to shut-off the gas when the flame is extinguished, and inoperability of the gas appliance. Notably, the first two of the exemplary problems can pose a significant danger to people and things near the gas appliance.

SUMMARY OF THE INVENTION

It is a primary object of the present invention to provide a gas appliance capable of achieving an open flame and also capable of maintaining the open flame in a relatively safe manner without the need for human supervision.

Another object of the present invention is to provide a gas appliance capable of providing an open flame and also capable of automatically terminating the flow of combustible gas to a nozzle of the gas appliance in response to extinguishment of the open flame.

According to yet another object of the present invention, the gas appliance includes at least one protective member capable of protecting critical elements of the gas appliance.

In order to achieve these and other objects, the present invention provides a gas appliance for producing an open flame. The gas appliance comprises an elongated gas tube, a gas inlet, a nozzle, a flame sensor, a gas shut-off valve, and a protective member. The elongated gas tube has a proximal end and a distal end. The gas inlet is located near the proximal end of the elongated gas tube, for connection to a source of combustible gas. The nozzle is located at the distal end of the elongated tube, for expelling the combustible gas to produce the open flame. The flame sensor is arranged on the gas appliance at a position where the open flame is detectable by the flame sensor. The gas shut-off valve is located between the gas inlet and the nozzle, and is responsive to absence of the open flame, as detected by the flame sensor, so that the gas shut-off valve closes when the flame is absent to prevent the combustible gas from flowing through the gas shut-off valve to the nozzle. The protective member is arranged around at least one of the flame sensor and the gas shut-off valve for protecting the flame sensor and/or the gas shut-off valve from damage.

The gas appliance preferably includes an over-ride mechanism which is manually actuatable to over-ride the gas shut-off valve by providing the combustible gas to the nozzle when the open flame is to be ignited.

The over-ride mechanism may be provided as part of the gas shut-off valve so that actuation of the over-ride mechanism causes the gas shut-off valve to open even if the flame is absent. Alternatively, the over-ride mechanism can be achieved using a bypass line which by-passes the gas shut-off valve.

The term "over-ride mechanism" therefore is not limited to arrangements wherein the over-ridden element is forced to operate in a manner contrary to its normal operating mode. To the contrary, this term also includes bypass arrangements wherein the over-ridden element is by-passed.

The flame sensor may be located at the nozzle, and preferably is located in the nozzle or within an outer tube of the nozzle which protects the flame sensor and thereby constitutes at least part of the protective member. Preferably, the flame sensor is provided in the form of a temperature sensor, such as a thermocouple. The flame sensor is adapted to detect absence of the open flame and to provide a signal indicative thereof At least one conductor (or other type of communication line) preferably is connected between the flame sensor and the gas shut-off valve. The conductor(s) is (are) arranged so as to carry a flame-absence-indicative signal to the gas shut-off valve to control opening and closing of the gas shut-off valve. A conductor housing extending from the flame sensor (or the nozzle) to the gas shut-off valve may be provided as at least part of the protective member, to protect the conductor(s) from damage. Preferably, the conductor housing is arranged at least partially around the conductor(s). A valve housing may be disposed around the gas shut-off valve as at least part of the protective member, to protect the gas shut-off valve from damage.

A gate valve preferably is connected between the gas inlet and the nozzle. The gate valve is actuatable between a closed position and an open position. In the closed position, the combustible gas from the gas inlet is precluded from flowing through the nozzle regardless of whether the gas shut-off valve is open. In the open position, by contrast, the combustible gas is free to flow to the gas shut-off valve and, if the gas shut-off valve is open, through the gas shut-off valve and the nozzle.

The nozzle preferably has a diameter which is larger than that of the elongated gas tube, and at least one air intake aperture capable of drawing air into the nozzle for mixing with the combustible gas when the combustible gas flows through the nozzle.

The gas shut-off valve, preferably, is located between the proximal end of the elongated gas tube and the gas inlet.

The present invention also provides a gas appliance for producing an open flame, wherein the gas appliance comprises an elongated gas tube, a gas inlet, a nozzle, a flame sensor, a gas shut-off valve having an over-ride mechanism, and a protective member. The elongated gas tube has a proximal end and a distal end. The gas inlet is located near the proximal end of the elongated gas tube, for connection to a source of combustible gas. The nozzle is located at the distal end of the elongated tube, for expelling the combustible gas to produce the open flame. The flame sensor is arranged on the gas appliance at a position where the open flame is detectable by the flame sensor. The gas shut-off valve has a valve inlet, a valve outlet, a control input, and the over-ride mechanism. The valve inlet is connected to the gas inlet. The valve outlet is connected to the proximal end of the elongated gas tube. The control input is responsive to absence of the open flame as detected by the flame sensor so that the gas shut-off valve automatically closes when the flame is absent to keep the combustible gas from flowing from the valve inlet through the valve outlet. The over-ride mechanism is manually actuatable to over-ride the control input by opening the valve inlet to the valve outlet even if the flame is absent. The protective member is arranged around at least one of the flame sensor and the gas shut-off valve to protect the flame sensor and/or the gas shut-off valve from damage.

The flame sensor is connected at least indirectly to the control input of the gas shut-off valve so that the gas shut-off valve automatically closes in response to a flame-absence-indicative signal from the flame sensor. The flame sensor preferably is located at the nozzle and may be defined by a temperature sensor, such as a thermocouple. The flame sensor may be located within the nozzle or within an outer nozzle tube of the nozzle, so that the nozzle protects the flame sensor and constitutes at least part of the protective member.

At least one conductor (or any other type of communication line) may be connected between the flame sensor and the control input of the gas shut-off valve. The conductor(s) is (are) arranged so as to carry the flame-absence-indicative signal to the control input of the gas shut-off valve. Preferably, a conductor housing which forms part of the protective member extends from the flame sensor (or nozzle) to the control input of the gas shut-off valve. The conductor housing is arranged at least partially around the conductor(s) and protects the conductor(s) from damage. A valve housing preferably is disposed around the gas shut-off valve as part of the protective member, to protect the gas shut-off valve from damage.

In addition, a gate valve may be connected between the gas inlet and valve inlet. The gate valve is actuatable between a closed position and an open position. In the closed position, the combustible gas from the gas inlet is precluded from flowing to the valve inlet regardless of whether the gas shut-off valve is open. In the open position, by contrast, the combustible gas is free to flow from the gas inlet to the valve inlet of the gas shut-off valve and, if the gas shut-off valve is open, through the gas shut-off valve and the nozzle.

The nozzle preferably has a diameter which is larger than that of the elongated gas tube and at least one air intake aperture capable of drawing air into the nozzle for mixing with the combustible gas when the combustible gas flows through the nozzle.

The present invention also achieves a method of providing combustible gas to the nozzle of the gas appliance in a manner dependent upon whether there is an open flame at the nozzle. The method includes the steps of protecting at least one of the control-related components (e.g., the gas shut-off valve and the flame sensor/thermocouple with its associated conductor/communication line) of the gas appliance by housing the control-related component(s) in a protective member; supplying the combustible gas to the gas shut-off valve; over-riding the gas shut-off valve to supply an initial amount of combustible gas to the nozzle of the gas appliance, igniting the initial amount of combustible gas at the nozzle of the gas appliance to produce an open flame; detecting whether the open flame remains ignited at the nozzle, directing the combustible gas through the gas shut-off valve and through the nozzle if the open flame remains ignited, and if the open flame has been extinguished, blocking the combustible gas from the nozzle so that the combustible gas cannot flow through the nozzle.

Preferably, the step of detecting whether the open flame remains ignited is performed continuously during the step of directing the combustible gas through the gas shut-off valve.

The above and other objects and advantages will become more readily apparent when reference is made to the following description taken in conjunction with the accompanying drawings.

DETAILED DESCRIPTION OF THE INVENTION

Figures 1, 2, 3:
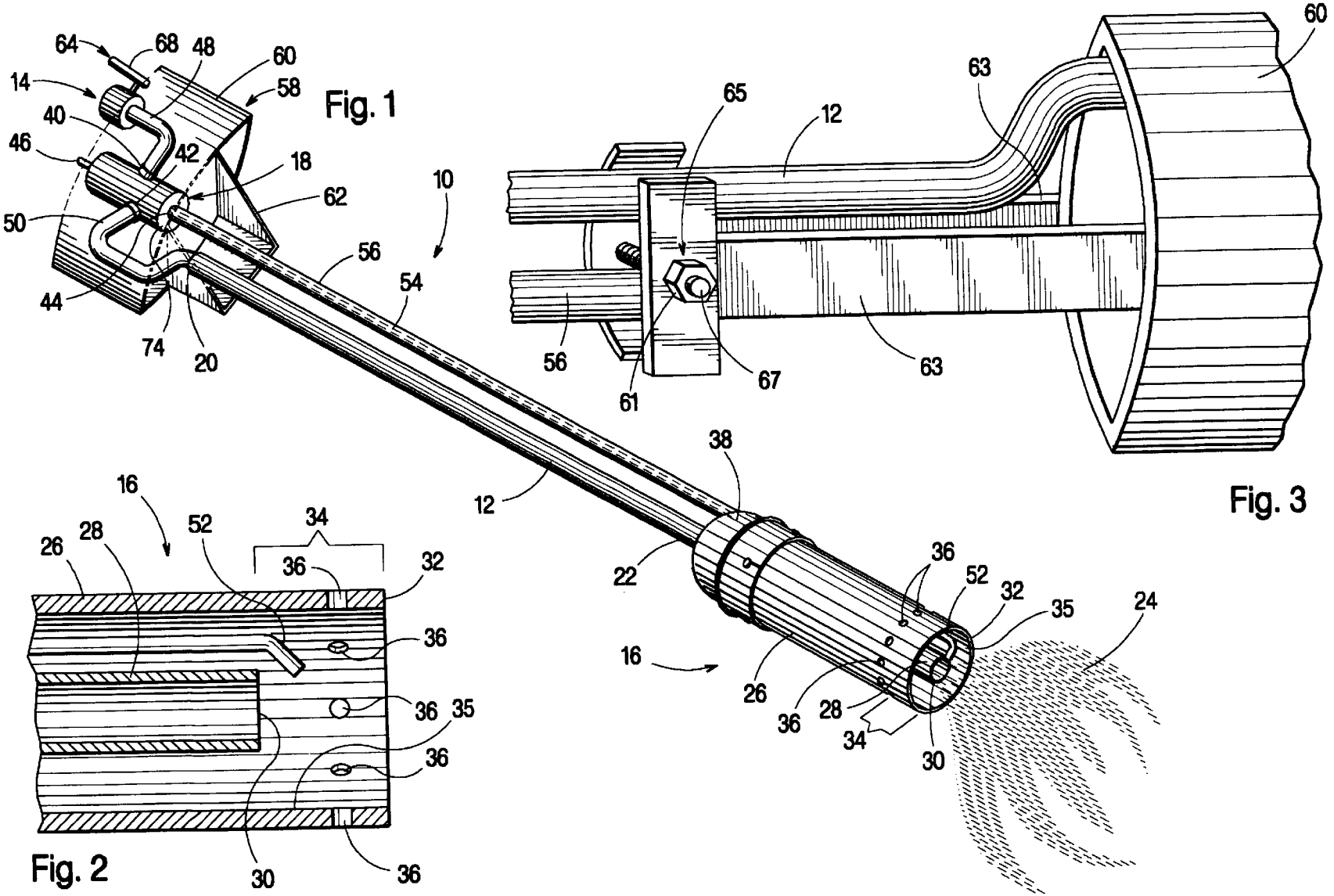
FIG. 1 is an isometric view of a gas appliance according to a preferred embodiment of the present invention.
FIG. 2 is a fragmentary cross sectional view taken through the nozzle of the gas appliance illustrated in FIG. 1.
FIG. 3 is a fragmentary elevation view of an alternative valve housing of the gas appliance illustrated in FIGS. 1 and 2.

FIG. 1 illustrates a gas appliance 10 for producing an open flame according to a preferred embodiment of the present invention. The gas appliance 10 has an elongated gas tube 12, a gas inlet 14, a nozzle 16, and a gas shut-off valve 18.

The elongated gas tube 12 has a proximal end 20 and a distal end 22. Preferably, the elongated gas tube 12 is between two and five feet long with a diameter of about ⅜ inch. The gas tube 12, however, is not limited to these dimensions. To the contrary, the actual length of the gas tube 12 will depend primarily on the intended use or uses of the gas appliance. Generally, when a large flame is to be produced by the gas appliance, the gas tube 12 will be longer. When such a large flame is not required, shorter lengths of the gas tube 12 can be provided.

The gas tube 12 preferably is made of steel, though it is understood that many other materials will suffice. The material should be compatible with the combustible gas which is to be communicated through the gas tube 12. It also should be strong and thick enough to reliably withstand the pressure of the gas and not leak, even if dropped or otherwise subjected to the type of abuse which is experience by tools in the industrial environment where the gas appliance 10 will be used.

The gas inlet 14 is located near the proximal end 20 of the elongated gas tube 12, for connection to a source of combustible gas. The gas inlet 14 may be threaded or otherwise provided with means to facilitate coupling of the gas inlet 14 to the source of combustible gas. This coupling preferably is achieved in a manner which minimizes the risk of leakage. The nozzle 16 is located at the distal end 22 of the gas tube 12. The gas tube 12 opens into the nozzle 16. Accordingly, any combustible gas flowing through the gas tube 12 is expelled through the nozzle 16. When this combustible gas is ignited, the open flame 24 is produced.

The nozzle 16 preferably includes two concentric nozzle tubes 26 and 28. The concentric nozzle tubes 26 and 28 are defined by an outer nozzle tube 26 and an inner nozzle tube 28. The inner nozzle tube 28 is connected to the distal end 22 of the elongated gas tube 12. Alternatively, the inner nozzle tube 28 may be defined as an extension of the elongated gas tube 12 into the nozzle 16. Inner nozzle tube 28 therefore receives any gas which passes through the gas tube 12 and discharges the gas through its distal end 30.

The outer nozzle tube 26 circumferentially surrounds the inner nozzle tube 28 and has a diameter which is larger than that of the elongated gas tube 12. The nozzle 16 therefore has an overall diameter which is greater than that of the gas tube 12.

The outer nozzle tube 26 has a distal end 32 which extends out beyond the distal end 30 of the inner nozzle tube 28. As a result, a volume 34 is defined in the nozzle 16, through which the inner nozzle tube 28 does not extend. This volume 34 is circumferentially delimited by the radially inner wall 35 of the outer nozzle tube 26.

At least one air intake aperture 36, and preferably, a plurality of such apertures 36 are provided in the outer nozzle tube 28. The apertures 36 are capable of drawing air into the nozzle for mixing with the combustible gas when the combustible gas flows through the nozzle 16. In particular, the flow of gas through the nozzle 16 creates a venturi effect which lowers the pressure between tubes 26 and 28 below atmospheric pressure. The resulting low pressure causes the air surrounding the nozzle 16 to be drawn into the nozzle 16 through apertures 36. This air mixes with the gas flowing through volume 34 to provide a suitable gas/air mixture. This gas/air mixture, when ignited, provides the open flame 24.

Although not illustrated in the drawings, it is understood that the apertures 36 may be selectively closable to vary the gas/air mixture. In addition, the apertures 36 need not be located exclusively around the volume 34. The apertures 36 may be placed anywhere along the length of tube 26 and/or may be located through an end cap 38 of the nozzle 16. As illustrated in FIG. 1, the end cap 38 circumferentially surrounds the distal end 22 of the gas tube 12 and structurally supports the outer nozzle tube 26 on the distal end 22.

The gas shut-off valve 18 is located between the gas inlet 14 and the nozzle 16. The gas shut-off valve 18 is responsive to absence of the open flame 24 so that, when the flame 24 is absent, the gas shut-off valve 18 closes to prevent the combustible gas from flowing through the gas shut-off valve 18 to the nozzle 16.

Preferably, as illustrated in FIG. 1, the gas shut-off valve 18 is located between the proximal end 20 of the elongated gas tube 12 and the gas inlet 14. The illustrated gas shut-off valve 18 has a valve inlet 40, a valve outlet 42, a control input 44, and an over-ride mechanism 46.

The valve inlet 40 is connected to the gas inlet 14 using an elbow pipe 48. The valve outlet 42 is connected to the proximal end 20 of the elongated gas tube 12 using a bend pipe 50. When the gas shut-off valve 18 is open, gas at the valve inlet 40 is free to flow through the valve 18 and out through the valve outlet 42. This gas then flows through the bend pipe 50, through the gas tube 12, and out through the nozzle 16.

When the gas shut-off valve 18 is closed, however, the gas at the valve inlet 40 is blocked by the valve 18 and therefore cannot flow out through the valve outlet 42. As a result, no gas is discharged through the nozzle 16.

The control input 44 automatically controls whether the shut-off valve 18 is open or closed. This control is carried out in response to the absence or presence of the flame 24. When the open flame 24 is absent, the control input 44 causes the gas shut-off valve 18 to automatically close. This keeps the combustible gas from flowing through the valve 18, from the valve inlet 40 through the valve outlet 42, to the nozzle 16 when the flame 24 is extinguished.

When the flame 24 is present, the gas shut-off valve 18 is kept open by the control input 44 and continues to feed gas through the valve outlet 42, through the bend pipe 50, through the elongated gas tube 12, and out through the nozzle 16.

If the flame 24 becomes extinguished and the valve 18 closes as a result thereof, the flow of gas can be manually re-established using the over-ride mechanism 46. In particular, the over-ride mechanism 46 provides a means for re-establishing the flow of gas and thereby facilitates re-ignition of the flame 24. When the over-ride mechanism 46 is pressed inwardly toward the control input 44, it manually opens the valve 18 to resume the flow of gas from the valve inlet 42 to the valve outlet 44. The gas discharged from the nozzle 16 as a result of this flow can be ignited to re-establish the flame 24. The over-ride mechanism 46 therefore, when pressed toward the control input 44, over-rides the control input 44 and allows the gas to flow through the valve 18 for purposes of re-igniting an extinguished flame 24.

After the flame 24 has been re-ignited, the control input 44 keeps the valve 18 open and the gas flowing, even if the over-ride mechanism 46 is released. Once the over-ride mechanism 46 is released, however, the control input 44 is free to terminate the flow of gas in response to extinguishment of the flame 24.

The over-ride mechanism 46 preferably is resiliently biased away from the control input 44 so that, unless it is manually actuated, the over-ride mechanism 46 allows the control input 44 to determine whether the valve 18 will be open or closed.

As illustrated in FIG. 1, the over-ride mechanism 46 may be provided as part of the gas shut-off valve 18 so that actuation of the over-ride mechanism 46 causes the gas shut-off valve 18 to open even if the flame 24 is absent. Alternatively, the over-ride mechanism can be achieved using a separate and distinct bypass line (not shown) which bypasses the gas shut-off valve 18.

The term "over-ride mechanism" therefore is not limited to arrangements wherein the over-ridden element is forced to operate in a manner contrary to its normal operating mode. To the contrary, this term also includes bypass arrangements wherein the over-ridden element is by-passed.

The gas appliance 10 includes a flame sensor 52 for detecting the absence of the flame 24. The flame sensor 52 may be located at the nozzle 16 and preferably is provided in the form of a temperature sensor, such as a thermocouple. The flame sensor 52 provides a signal indicative of whether the flame 24 is present or absent.

As illustrated in FIGS. 1and 2, the flame sensor 52 preferably is located within the nozzle 16 so that the nozzle 16 protects the flame sensor 52 from damage. In particular, the flame sensor 52 extends into the volume 34 and is protected from damage by the outer nozzle tube 26 of the nozzle 16.

In the volume 34, the flame sensor 52 is exposed to heat generated by the flame 24 whenever the flame 24 is present. If the flame sensor 52 is provided in the form of a heat sensor, such as a thermocouple, the signal provided by the flame sensor 52 will vary in response to the heat from the flame 24. A thermocouple, for example, provides an output voltage which varies as a function of temperature. This output voltage is applied to the control input 44 of the valve 18 and therefore communicates the presence or absence of the flame 24 to the valve 18.

An exemplary thermocouple which can be used as the flame sensor 52 is commercially available from Johnson Controls, Inc. and has been marketed as a Type K16RM Replacement Thermocouple.

Valves which are responsive to the output voltage from such a thermocouple and which are suitable for use as the gas shut-off valve 18 are commercially available from Johnson Controls, Inc. and have been marketed using the trademark BASO®. Preferably, the pressure in the gas appliance 10 does not exceed 25 PSIG (or 172 kPa), though it is understood that the present invention is not limited in this respect. An exemplary valve which can be used as the gas shut-off valve 18 when such pressures are applied has been marketed by Johnson Controls, Inc. as the H19 Series BASO® valve.

At least one conductor 54 preferably is connected between the flame sensor 52 and the gas shut-off valve 18. The conductor(s) 54 is (are) arranged so as to carry a flame-absence-indicative signal to the gas shut-off valve 18 to control opening and closing of the gas shut-off valve 18. In particular, the signal is applied to the control input 44 of the valve 18.

A conductor housing 56 extending from the flame sensor 52 (or the nozzle 16) to the gas shut-off valve 18 may be provided to protect the conductor(s) 54 from damage. The illustrated conductor housing 56 actually extends to the control input 44 of the gas shut-off valve 18. Preferably, the conductor housing 56 is arranged at least partially around the conductor(s) 54. In the illustrated embodiment, the conductor housing 56 is tubular in configuration and extends completely around the circumference of the conductor(s) 54.

A valve housing 58 may be disposed around the gas shut-off valve 18 to protect the gas shut-off valve 18 from damage. As illustrated in FIG. 1, the valve housing 58 preferably includes a band portion 60 circumferentially surrounding the valve 18 and a wedge portion 62 out from which the conductor housing 56 and the gas tube 12 extend. Although the valve housing 58 is illustrated in a transparent manner to facilitate visualization of the components contained therein, the valve housing 58 typically will be made using an opaque material which is relatively inexpensive, yet strong enough to provide adequate protection for the valve 18. A preferred example of this material is steel, though it is understood that many other materials will suffice.

Notably, the outer nozzle tube 26, the valve housing 58, and the conductor housing 56 are combined to provide a protective member which keeps the critical elements of the gas appliance (e.g., the valve 18, conductor(s) 54, and flame sensor 52) protected for direct impact when the gas appliance 10 is dropped or when objects are dropped on the gas appliance 10. It is understood, however, that the protective member may be provided using less than all of the elements shown in the illustrated embodiment. In this regard, the term "protective member" is not limited to those members which include each of the tube 26, housing 58 and housing 56.

FIG. 3 shows an alternative embodiment of the valve housing 58. In the alternative embodiment, the wedge portion 62 is defined by generally T-shaped arms 63 extending forward of the band portion 60, along opposite sides of the gas tube 12 and conductor housing 56. The T-shaped arms 63 are secured to the gas tube 12 and conductor housing 56 by tightening of a suitable fastener 65, such as the illustrated nut 61 and bolt 67 combination. The bolt 67 passes through holes in the T-shaped arms 63 and threadedly engages the nut 61. Tightening of this threaded engagement is what draws the arms 63 tightly in toward one another and secures the gas tube 12 and conductor housing 56 therebetween.

A gate valve 64 may be connected between the gas inlet 14 and the nozzle 16. The gate valve 64 is manually actuatable between a closed position and an open position. The closed position is achieved by turning a handle 68 of the gate valve 64 to provide a transverse orientation of the handle 68 with respect to the direction of gas flow through the gas inlet 14, whereas the open position is achieved by turning the same handle 68 ninety degrees to an orientation which is aligned with the direction of gas flow.

In the closed position, the combustible gas from the gas inlet 14 is precluded from flowing through the nozzle 16 regardless of whether the gas shut-off valve 18 is open. In the open position, by contrast, the combustible gas is free to flow to the gas shut-off valve 18 and, if the gas shut-off valve 18 is open, through the gas shut-off valve 18 and the nozzle 16.

Preferably, the gate valve 64 is located between the gas inlet 14 and the elbow pipe 48, thereby placing the gate valve 64 between the gas inlet 14 and the valve inlet 40. Thus, in the closed position, the combustible gas from the gas inlet 14 is precluded from flowing to the valve inlet 40 regardless of whether the gas shut-off valve 18 is open. In the open position, by contrast, the combustible gas is free to flow from the gas inlet 14 to the valve inlet 40 of the gas shut-off valve 18 and, if the gas shut-off valve 18 is open, through the gas shut-off valve 18 and the nozzle 16. Preferably, the valve housing 58 also houses the gate valve 64 to protect it from damage.

The present invention, of course, is not limited to the illustrated position of the gate valve 64. The gate valve 64 may be located virtually anywhere along the elbow pipe 48, bend pipe 50, elongated gas tube 12, or inner nozzle tube 28, to provide a positive way of manually terminating the flow of gas through the gas appliance 10. The illustrated position is preferred because it performs this termination before the combustible gas reaches the other components of the gas appliance 10 and because the gate valve 64 is protected from damage by the valve housing 58.

At least the valve housing 58, conductor housing 56, elongated tube 12, and outer nozzle tube 26 preferably are made of steel or another durable material so that the gas appliance 10 can be dropped from a height of at least three feet, three or more times, without sustaining damage.

Figure 4:
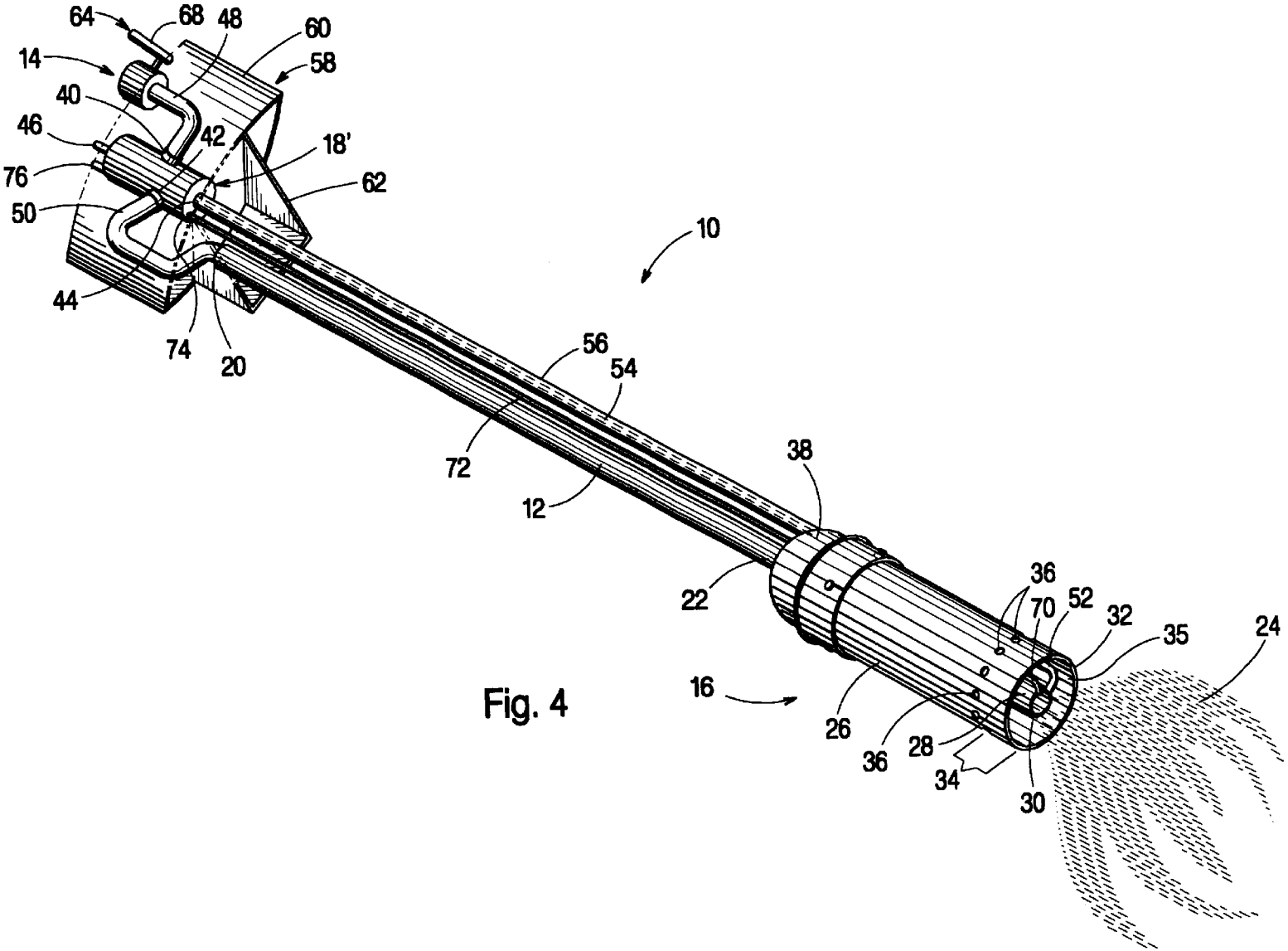
FIG. 4 is an isometric view of a gas appliance according to an alternative embodiment of the present invention.

With reference to FIG. 4, the gas appliance 10 also may include a suitable pilot light for use in igniting the open flame 24. In FIG. 4, components similar to those of the embodiments illustrated in FIGS. 1-3 are denoted using the same reference numbers and operate in a similar manner.

The pilot light system of FIG. 4 is defined by the combination of a pilot gas valve outlet 74 of the gas shut-off valve 18', a pilot gas discharge 70, and a pilot feed tube 72. The pilot light system provides combustible gas at a much lower rate than the elongated tube 12, and therefore produces a pilot flame which is significantly smaller than the open flame 24.

The pilot flame is produced near the nozzle 16 to facilitate ignition of the combustible gas as it gets discharged by the nozzle 16. The pilot gas discharge 70 therefore is located at the nozzle 16. Preferably, the pilot gas discharge 70 is located within the outer nozzle tube 26 so that the pilot gas discharge 70 is protected from damage by the outer nozzle tube 26 when the appliance 10 is used in an industrial environment.

The gas shut-off valve 18' differs from the one illustrated in FIGS. 1–3 in that the valve 18' further includes a pilot gas shut-off valve which, when open, feeds combustible gas to the pilot gas valve outlet 74. From the pilot gas valve outlet 74, the combustible gas flows through the pilot feed tube 72 to the nozzle 16, where it is discharged through the pilot gas discharge 70.

Included in the pilot gas shut-off valve is a pilot gas shut-off valve over-ride mechanism 76. Normally, the pilot gas shut-off valve stays open when the pilot flame is present and closes when the pilot flame is absent. This prevents gas from accumulating as a result of pilot gas discharge, even if the pilot flame is inadvertently extinguished. When the over-ride mechanism 76 is actuated, however, by manually pressing it toward the nozzle 16, the combustible gas flows through the pilot gas shut-off valve regardless of whether the pilot flame is present. Actuation of the over-ride mechanism 76 therefore permits initial lighting of the pilot flame.

In the illustrated arrangement, the entire gas shut-off valve 18 is operated based on the signal from the same flame sensor 52. There is consequently only one flame sensor 52, and this flame sensor 52 is located at a position where both the pilot flame and the open flame 24 can be detected.

Alternatively, a separate flame sensor can be provided for each aspect of the gas shut-off valve, that is, one for the main gas shut-off valve and one for the pilot gas shut-off valve. The one for the pilot gas shut-off valve would be located at a position where the pilot flame is detectable, whereas the other flame sensor would be located away from where the pilot flame is detected but within an area where the open flame 24 can be detected.

Standby operation of the pilot-light-equipped gas appliance 10 is initiated by pressing the over-ride mechanism 76 and holding it down for a few seconds. An ignition source (e.g., a lit match or a striker) is used to ignite the pilot flame while the over-ride mechanism 76 is held down. As soon as the flame sensor 52 detects the presence of the pilot flame, the over-ride mechanism 76 can be released and the pilot gas shut-off valve will maintain the flow of gas to the pilot gas discharge 70 so long as the pilot flame remains burning.

While the gas appliance 10 operates in this standby mode, the open flame 24 is absent. The open flame 24 can be ignited, however, by depressing the main over-ride mechanism 46. This causes gas to flow from the gas shut-off valve 18', through the elongated tube 12, and out through the nozzle 16. As the combustible gas flows out through the distal end 30 of the inner nozzle tube 28, it is ignited by the pilot flame and thereby produces the open flame 24. When the gas shut-off valve 18' detects the presence of the open flame 24 via the flame sensor 52, the over-ride mechanism 46 can be released without causing extinguishment of the open flame 24. The open flame 24 and gas appliance 10 therefore can be left unattended to provide heat and/or combustion of undesirable gases.

Should the open flame 24 become extinguished because of wind or for other reasons, the gas shut-off valve 18' will automatically terminate the flow of gas through the inner nozzle tube 28 if the open flame 24 is not immediately reignited by the pilot flame. This prevents inadvertent and dangerous accumulations of the combustible gas. If the pilot flame also is extinguished, then the pilot gas shut-off valve closes and dangerous gas accumulations again are avoided.

While the illustrated embodiments include only one gate valve 64, it is understood that separate gate valves can be provided to permit independent manual control of the flow of gas to the pilot feed tube 72 and to the elongated gas tube 12. This way, the flow of gas can be manually blocked from either or both of the elongated gas tube 12 and the pilot feed tube 72. By closing the gate valve corresponding to the elongated gas tube 12, the open flame 24 can be extinguished to place the gas appliance 10 back into the standby mode. In the standby mode, the open flame is extinguished while the pilot flame remains ignited and ready to ignite combustible gas from the elongated gas tube 12 should the flow of that gas be re-established by opening of the corresponding gate valve and actuation of the over-ride mechanism 46.

Similarly, the illustrated gate valve 64 can be kept in the illustrated position and an additional gate valve can be provided for only the elongated gas tube 12. This would permit manual termination of the flow of gas to the elongated gas tube 12, as well as manual termination of the flow of gas to both the elongated gas tube 12 and the pilot feed tube 72. A similar arrangement can be provided with the illustrated gate valve 64 and an additional gate valve for only the pilot feed tube 72 should it become necessary to extinguish the pilot flame while the open flame 24 remains ignited.

The embodiments illustrated in FIGS. 1–4 provide an open flame 24 while advantageously avoiding the build-up of dangerous levels of combustible gas. Advantageously, the open flame 24 is "thrown" or extends several feet forward of the nozzle 16. Preferably, the flow of gas is provided such that the flame extends 2–7 feet forward of the nozzle 16.

Since all of the control-related components (e.g., the gas shut-off valve 18 or 18', the gate valve 64, the pilot light discharge 70 (if used) and the flame sensor 52/thermocouple with its associated conductor 54) are protected by a suitable part of the protective member in the preferred embodiments, it is unlikely that the preferred embodiments of the gas appliance 10 will be rendered inoperative or unsafe when subjected to the kind of abuse which tools typically experience in an industrial environment.

The illustrated gas appliance 10 advantageously can be configured with virtually any desired length, can be configured with or without the pilot light, can be used in any orientation, e.g., up, down, or any orientation therebetween, can be used safely in windy conditions, and can be left unattended when operating because the gas shut-off valve 18 automatically terminates the flow of gas to the nozzle 16 if the flame 24 is extinguished. If the pilot light is used, the gas shut-off valve can be used to terminate the flow of gas to the pilot light in the event that the small flame of the pilot light is extinguished.

Since the gas appliance 10 automatically terminates the flow of gas when the flame 24 is extinguished, it advantageously satisfies the requirements of 29 C.F.R. § 1910.110 (c)(5)(h) for devices which are to be left unattended. The gas appliance 10 therefore is capable of achieving an open flame and also capable of maintaining the open flame in a relatively safe manner without the need for human supervision.

Notably, the preferred embodiments provide a gas appliance 10 which is relatively uncomplicated to produce, thereby minimizing manufacturing costs, and which, despite the lack of complexity, is durable enough to withstand use in industrial environments.

The present invention also achieves a method of providing combustible gas to the nozzle 16 of the gas appliance 10 in a manner dependent upon whether there is an open flame 24 at the nozzle 16. The method includes the steps of protecting at least one of the control-related components (e.g., the gas shut-off valve 18, the gate valve 64, and the flame sensor 52/thermocouple with its associated conductor 54) of the gas appliance by housing the control-related component(s) in a protective member; supplying the combustible gas to the gas shut-off valve 18, over-riding the gas shut-off valve 18 (e.g., using the over-ride mechanism 46) to supply an initial amount of combustible gas to the nozzle 16 of the gas appliance 10; igniting the initial amount of combustible gas at the nozzle 16 of the gas appliance 10 to produce an open flame 24; detecting whether the open flame 24 remains ignited at the nozzle (e.g., using the flame sensor 52 and the conductor(s) 54 to convey a signal indicative of the detection); directing the combustible gas through the gas shut-off valve 18 and through the nozzle 16 if the open flame 24 remains ignited; and if the open flame 24 has been extinguished, blocking the combustible gas from the nozzle 16 so that the combustible gas cannot flow through the nozzle 16 (e.g., by supplying a signal indicative of flame absence from the flame sensor 52 to the control input 44, and thereby causing the gas shut-off valve to close).

Preferably, the step of detecting whether the open flame 24 remains ignited is performed continuously during the step of directing the combustible gas through the gas shut-off valve 18.

The gas appliance and method may be used with combustible gases such as manufactured, natural, mixed or LP gas (e.g., propane and natural gas).

While this invention has been described as having a preferred design, it is understood that the invention is not limited to the illustrated and described features. To the contrary, the invention is capable of further modifications, usages, and/or adaptations following the general principals of the invention and therefore includes such departures from the present disclosure as come within known or customary practice in the art to which the invention pertains, and as may be applied to the central features set forth above, and which fall within the scope of the appended claims.

I claim:

1. A gas appliance for producing an open flame, comprising:

a) an elongated gas tube having a proximal end and a distal end;

b) a gas inlet near the proximal end of the elongated gas tube, for connection to a source of combustible gas;

c) a nozzle located at the distal end of the elongated tube, for expelling the combustible gas to produce the open flame;

d) a flame sensor arranged on the gas appliance at a position where the open flame is detectable by the flame sensor;

e) a gas shut-off valve located between the gas inlet and the nozzle, the gas shut-off valve being responsive to absence of the open flame as detected by the flame sensor so that the gas shut-off valve closes when the flame is absent to prevent the combustible gas from flowing through the gas shut-off valve to the nozzle, f) protective members arranged around the flame sensor and the gas shut-off valve for protecting the flame sensor and the gas shut-off valve from damage; and g) an over-ride mechanism which is actuatable to over-ride the gas shut-off valve by providing the combustible gas to the nozzle when the open flame is to be ignited.

2. The gas appliance of claim 1, wherein the over-ride mechanism is manually actuatable.

3. The gas appliance of claim 1, wherein said over-ride mechanism is part of the gas shut-off valve, and wherein said over-ride mechanism, when actuated, causes said gas shut-off valve to open despite an absence of the open flame.

4. The gas appliance of claim 1, wherein said flame sensor is located at the nozzle.

5. The gas appliance of claim 4, wherein said nozzle includes an outer nozzle tube and an inner nozzle tube, said flame sensor being located within said outer nozzle tube so that said outer nozzle tube constitutes at least part of at least one of said protective members, said inner nozzle tube being connected to said elongated gas tube so that gas is communicated from said elongated gas tube to the inner nozzle tube and is discharged by the inner nozzle tube.

6. The gas appliance of claim 1, wherein said flame sensor is a temperature sensor.

7. The gas appliance of claim 6, wherein said temperature sensor is a thermocouple.

8. The gas appliance of claim 1, further comprising at least one communication line connected between the flame sensor and the gas shut-off valve, said at least one communication line being arranged so as to carry a flame-absence-indicative signal to the gas shut-off valve to control opening and closing of the gas shut-off valve.

9. The gas appliance of claim 8, wherein at least one of said protective members includes a communication line housing extending from the flame sensor to the gas shut-off valve, to protect said at least one communication line from damage.

10. The gas appliance of claim 1, wherein at least one of said protective members includes a valve housing disposed around the gas shut-off valve to protect the gas shut-off valve from damage.

11. The gas appliance of claim 1, further comprising a gate valve connected between the gas inlet and the nozzle, the gate valve being actuatable between:

a) a closed position wherein the combustible gas from the gas inlet is precluded from flowing through the nozzle regardless of whether the gas shut-off valve is open; and b) an open position wherein the combustible gas is free to flow to the gas shut-off valve and, if the gas shut-off valve is open, through the gas shut-off valve and the nozzle.

12. The gas appliance of claim 1, wherein the nozzle has a diameter which is larger than that of the elongated gas tube.

13. The gas appliance of claim 12, wherein the nozzle has at least one air intake aperture capable of drawing air into the nozzle for mixing with the combustible gas when the combustible gas flows through the nozzle.

14. The gas appliance of claim 1, wherein said gas shut-off valve is located between the proximal end of the elongated gas tube and the gas inlet.

15. The gas appliance of claim 14, wherein said flame sensor is located at the nozzle.

16. The gas appliance of claim 15, wherein said nozzle includes an outer nozzle tube and an inner nozzle tube, said flame sensor being located within said outer nozzle tube so that said outer nozzle tube constitutes at least part of at least one of said protective members, said inner nozzle tube being connected to said elongated gas tube so that gas is communicated from said elongated gas tube to the inner nozzle tube and is discharged by the inner nozzle tube.

17. The gas appliance of claim 14, wherein said flame sensor is a temperature sensor.

18. The gas appliance of claim 17, wherein said temperature sensor is a thermocouple.

19. The gas appliance of claim 14, further comprising at least one communication line connected between the flame sensor and the gas shut-off valve, said at least one communication line being arranged so as to carry a flame-absence-indicative signal to the gas shut-off valve to control opening and closing of the gas shut-off valve.

20. The gas appliance of claim 19, wherein at least one of said protective members includes a communication line housing extending from the flame sensor to the gas shut-off valve, to protect said at least one communication line from damage.

21. The gas appliance of claim 14, wherein at least one of said protective members includes a valve housing disposed around the gas shut-off valve to protect the gas shut-off valve from damage.

22. The gas appliance of claim 14, further comprising a gate valve connected between the gas inlet and the nozzle, the gate valve being actuatable between:

a) a closed position wherein the combustible gas from the gas inlet is precluded from flowing through the nozzle regardless of whether the gas shut-off valve is open; and b) an open position wherein the combustible gas is free to flow to the gas shut-off valve and, if the gas shut-off valve is open, through the gas shut-off valve and the nozzle.

23. The gas appliance of claim 14, wherein the nozzle has a diameter which is larger than that of the elongated gas tube.

24. The gas appliance of claim 23, wherein the nozzle has at least one air intake aperture capable of drawing air into the nozzle for mixing with the combustible gas when the combustible gas flows through the nozzle.

25. The gas appliance of claim 23, further comprising:

a) a flame sensor located within the nozzle so that the nozzle protects the flame sensor and constitutes at least part of at least one of said protective members; and b) at least one communication line extending from the flame sensor to the gas shut-off valve, for carrying said signal to the gas shut-off valve.

26. The gas appliance of claim 25, wherein at least one of said protective members further includes a communication line housing extending from the gas shut-off valve to the nozzle, the communication line housing being arranged at least partially around said at least one communication line to protect said at least one communication line from damage.

27. The gas appliance of claim 1, further comprising a pilot light system including a pilot gas discharge, for producing a pilot flame which is significantly smaller than the open flame, said pilot light system being arranged so that the pilot flame is produced near the nozzle to facilitate ignition of the combustible gas using the pilot flame.

28. The gas appliance of claim 27, wherein said pilot light system includes a pilot gas shut-off valve which automatically closes when the pilot flame is extinguished.

29. The gas appliance of claim 28, further comprising a pilot gas shut-off valve over-ride mechanism which is actuatable to permit said pilot light system to discharge combustible gas regardless of whether the pilot shut-off valve is open, to facilitate ignition of the pilot flame.

30. The gas appliance of claim 27, wherein said nozzle includes an outer nozzle tube and an inner nozzle tube, said flame sensor being located within said outer nozzle tube so that said outer nozzle tube constitutes at least part of at least one of said protective members, said inner nozzle tube being connected to said elongated gas tube so that gas is communicated from said elongated gas tube to the inner nozzle tube and is discharged by the inner nozzle tube; and wherein said pilot gas discharge is located within said outer nozzle tube so that said pilot gas discharge is protected from damage by the outer nozzle tube.

31. A gas appliance for producing an open flame, comprising:

a) an elongated gas tube having a proximal end and a distal end;

b) a gas inlet near the proximal end of the elongated gas tube, for connection to a source of combustible gas;

c) a nozzle located at the distal end of the elongated tube, for expelling the combustible gas to produce the open flame;

d) a flame sensor arranged on the gas appliance at a position where the open flame is detectable by the flame sensor;

e) a gas shut-off valve having;
   i) a valve inlet connected to the gas inlet,
   ii) a valve outlet connected to the proximal end of the elongated gas tube,
   iii) a control input responsive to absence of the open flame as detected by the flame sensor so that the gas shut-off valve automatically closes when the flame is absent to keep the combustible gas from flowing from the valve inlet through the valve outlet, and
   iv) an over-ride mechanism which is manually actuatable to over-ride the control input by opening the valve inlet to the valve outlet even if the flame is absent; and f) a protective members arranged around the flame sensor and the gas shut-off valve to protect said the flame sensor and the gas shut-off valve from damage.

32. The gas appliance of claim 31, wherein said flame sensor is connected at least indirectly to the control input of the gas shut-off valve so that the gas shut-off valve automatically closes in response to a flame-absence-indicative signal from the flame sensor to the control input.

33. The gas appliance of claim 31, wherein said flame sensor is located at the nozzle.

34. The gas appliance of claim 31, wherein said flame sensor is a temperature sensor.

35. The gas appliance of claim 33, wherein said temperature sensor is a thermocouple.

36. The gas appliance of claim 32, further comprising at least one communication line connected between the flame sensor and the control input of the gas shut-off valve, said at least one communication line being arranged so as to carry the flame-absence-indicative signal to the control input of the gas shut-off valve.

37. The gas appliance of claim 35, wherein at least one of said protective members includes a communication line housing extending from the flame sensor to the control input of the gas shut-off valve, to protect said at least one communication line from damage.

38. The gas appliance of claim 31, at least one of said protective members includes a valve housing disposed around the gas shut-off valve to protect the gas shut-off valve from damage.

39. The gas appliance of claim 31, further comprising a gate valve connected between the gas inlet and valve inlet, the gate valve being actuatable between:

a) a closed position wherein the combustible gas from the gas inlet is precluded from flowing to the valve inlet regardless of whether the gas shut-off valve is open; and b) an open position wherein the combustible gas is free to flow from the gas inlet to the valve inlet of the gas shut-off valve and, if the gas shut-off valve is open, through the gas shut-off valve and the nozzle.

40. The gas appliance of claim 31, wherein the nozzle has a diameter which is larger than that of the elongated gas tube.

41. The gas appliance of claim 31, wherein the nozzle has at least one air intake aperture capable of drawing air into the nozzle for mixing with the combustible gas when the combustible gas flows through the nozzle.

42. The gas appliance of claim 31, wherein said nozzle includes an outer nozzle tube and an inner nozzle tube, said flame sensor being located within said outer nozzle tube so that said outer nozzle tube protects said flame sensor and constitutes at least part of at least one of said protective members, said inner nozzle tube being connected to said elongated gas tube so that gas is communicated from said elongated gas tube to the inner nozzle tube and is discharged by the inner nozzle tube.

43. The gas appliance of claim 42, and further comprising at least one communication line extending from the flame sensor to the control input of the gas shut-off valve, for carrying a signal indicative of flame absence to the control input of the gas shut-off valve, and wherein at least one of said protective members includes a communication line housing extending from the control input of the gas shut-off valve to the nozzle, the communication line housing being arranged at least partially around said at least one communication line to protect said at least one communication line from damage.

44. The gas appliance of claim 43, wherein said at least one of protective members further includes a valve housing disposed around the gas shut-off valve to protect the gas shut-off valve from damage.

45. The gas appliance of claim 31, wherein:

a) said nozzle includes an outer nozzle tube and an inner nozzle tube, said inner nozzle tube being connected to said elongated gas tube so that gas is communicated from said elongated gas tube to the inner nozzle tube and is discharged by the inner nozzle tube;

b) said flame sensor is located within said outer nozzle tube so that said outer nozzle tube protects said flame sensor and constitutes part of one of said protective member;

c) said flame sensor is connected to said control input by a communication line which extends between said flame sensor and said control input; and d) the other of said protective members further includes;
   i) a valve housing disposed around the gas shut-off valve to protect the gas shut-off valve from damage, and
   ii) a tubular communication line housing surrounding said communication line and extending between said nozzle and the valve housing to protect the communication line from damage.

46. The gas appliance of claim 31, further comprising a pilot light system including a pilot gas discharge, for producing a pilot flame which is significantly smaller than the open flame, said pilot light system being arranged so that the pilot flame is produced near the nozzle to facilitate ignition of the combustible gas using the pilot flame.

47. The gas appliance of claim 46, wherein said pilot light system includes a pilot gas shut-off valve which automatically closes when the pilot flame is extinguished.

48. The gas appliance of claim 47, further comprising a pilot gas shut-off valve over-ride mechanism which is actuatable to permit said pilot light system to discharge combustible gas regardless of whether the pilot shut-off valve is open, to facilitate ignition of the pilot flame.

49. The gas appliance of claim 46, wherein said nozzle includes an outer nozzle tube and an inner nozzle tube, said flame sensor being located within said outer nozzle tube so that said outer nozzle tube constitutes at least part of at least one of said protective members, said inner nozzle tube being connected to said elongated gas tube so that gas is communicated from said elongated gas tube to the inner nozzle tube and is discharged by the inner nozzle tube , and wherein said pilot gas discharge is located within said outer nozzle tube so that said pilot gas discharge is protected from damage by the outer nozzle tube.

50. A method of providing combustible gas to a nozzle of a gas appliance in a manner dependent upon whether there is an open flame at the nozzle, wherein the gas appliance includes several control-related components including a flame sensor and a gas shut-off valve, said method comprising the steps of:

a) protecting control-related components of the gas appliance by housing said control-related components in protective members;

b) supplying a combustible gas to the gas shut-off valve;

c) over-riding the gas shut-off valve to supply an initial amount of combustible gas to a nozzle of the gas appliance;

d) igniting the initial amount of combustible gas at the nozzle of the gas appliance to produce an open flame;

e) detecting whether the open flame remains ignited at the nozzle;

f) directing the combustible gas through the gas shut-off valve and through the nozzle if the open flame remains ignited; and g) if the open flame has been extinguished, blocking the combustible gas from the nozzle so that the combustible gas cannot flow through the nozzle.

51. The method of claim 50, wherein said step of detecting whether the open flame remains ignited is performed continuously during the step of directing the combustible gas through the gas shut-off valve.

* * * * *